US005434946A

United States Patent [19]

Barzilai et al.

[11] Patent Number: 5,434,946

[45] Date of Patent: Jul. 18, 1995

[54] HAIR DRYER WITH CONTINUOUSLY VARIABLE HEAT INTENSITY AND AIR FLOW SPEED

[75] Inventors: Yinon Barzilai; William Levy; Mikhail Mitelman, all of El Paso, Tex.

[73] Assignee: Helen Of Troy Corporation, El Paso, Tex.

[21] Appl. No.: 191,094

[22] Filed: Feb. 3, 1994

[51] Int. Cl.[6] ..... A45D 20/10

[52] U.S. Cl. ..... 392/385; 34/96

[58] Field of Search ..... 392/385, 379–384, 392/360–369; 34/96–101

[56] References Cited

U.S. PATENT DOCUMENTS

| | | | |
|---|---|---|---|
| 1,528,300 | 3/1925 | Noonan | 392/361 |
| 1,573,944 | 2/1926 | Jancke | 392/383 |
| 3,911,934 | 10/1975 | Helbling | 34/96 |
| 4,003,388 | 1/1977 | Nopanen | 392/384 |
| 4,013,083 | 3/1977 | Helbling | 392/380 |
| 4,260,875 | 4/1981 | Walter et al. | 392/385 |
| 4,263,500 | 4/1981 | Springer et al. | 392/385 |
| 4,297,564 | 10/1987 | Bartolac | 392/385 |
| 4,309,595 | 1/1982 | Long et al. | 392/385 |
| 4,316,077 | 2/1982 | Carlson | 392/385 |
| 4,327,278 | 4/1982 | Tomaro | 392/385 |
| 4,711,988 | 12/1987 | Thaler et al. | 392/385 |
| 4,794,225 | 12/1988 | Maese | 392/385 |
| 4,972,065 | 11/1990 | Ohlsen | 392/380 |
| 5,195,164 | 3/1993 | Lambert | 392/385 |

FOREIGN PATENT DOCUMENTS

| | | | |
|---|---|---|---|
| 53-111863 | 9/1978 | Japan | 392/380 |
| 2150771 | 7/1985 | United Kingdom | 392/379 |

*Primary Examiner*—John A. Jeffery
*Attorney, Agent, or Firm*—John R. Flanagan

[57] ABSTRACT

A hair dryer has an electric heating element adapted to produce any desired intensity of heat output within a continuous range of heat intensities and an electric blower adapted to produce any desired speed of air flow within a continuous range of air flow speeds which is then heated by intensity of the heat output of the heating element to produce any desired heated air flow output. The hair dryer also has a control circuit electrically connected to the heating element and blower and being operable upon actuation by a pair of momentary switches to simultaneously regulate operation of the heater element and blower to produce a continuously variable heated air flow output. The continuously variable simultaneous regulation of the heat output intensity and air flow output speed is driven or powered in opposite directions by a user manually manipulating the pair of momentary switches respectively labelled "Up" and "Down". The longer the period of time that the "Up" momentary switch is pressed by the user, the more the intensity of heat output and the speed of air flow output are increased. The longer the period of time that the "Down" momentary switch is pressed by the user, the more the intensity of heat output and the speed of air flow output are decreased.

16 Claims, 2 Drawing Sheets

HAIR DRYER WITH CONTINUOUSLY VARIABLE HEAT INTENSITY AND AIR FLOW SPEED

BACKGROUND OF THE INVENTION

1. Field of the Invention

The present invention generally relates to hair dryers and, more particularly, is concerned with a hair dryer having a control circuit actuated by manipulating a pair of momentary switches to simultaneously and continuously variably regulate operation of a heater element and blower to produce any desired heated air flow output having any desired heat intensity and air flow speed falling within respective continuous ranges of heat intensities and air flow speeds.

2. Description of the Prior Art

A portable hair dryer typically includes a hollow housing with an inlet and an outlet, an electric blower mounted in the housing which serves as a means for inducing the flow of air through the housing from the inlet to the outlet thereof when the hair dryer is in use, and a heater element mounted in the housing which serves as a means for heating the air flow between the inlet and outlet of the housing. Also, many hair dryers provide different heat intensity levels and air flow speeds to accommodate the variety of needs of different users.

Representative examples of hair dryers with variable heat intensities and air flow speed are the ones disclosed in U.S. patents to Walter et al (U.S. Pat. No. 4,260,875), Long et al (U.S. Pat. No. 4,309,595), Tomaro (U.S. Pat. No. 4,327,278), Maese (U.S. Pat. No. 4,794,225), Thaler et al (U.S. Pat. No. 4,711,988), and Lambert (U.S. Pat. No. 5,195,164).

U.S. Pat. No. 4,260,875 to Walter et al and U.S. Pat. No. 4,309,595 to Long et al each discloses a hair dryer having a switch which is moved between high and low positions to control corresponding levels of both blower speed and power to a heater element. U.S. Pat. No. 4,316,077 to Tomaro discloses a hair dryer having a multiple speed control circuit for providing four heat and two speed levels. U.S. Pat. No. 4,794,225 to Maese discloses a hair dryer having a switch to operate the dryer at several different heat and air flow rates.

U.S. Pat. No. 4,711,988 to Thaler et al discloses a hair dryer having a three-position rocker switch, a two-position rocker switch and a three-position trigger switch for controlling operation thereof. The three-position rocker switch provides control of the blower and heater element and has an "off" position for cutting power off to both the blower and heater element, a "low" position for low blower speed and low heater element heat intensity generation, and a "high" position for high blower speed and high heater element heat intensity generation. The two-position rocker switch has a "warm" position for relative low heat intensity generation rate and a "hot" position for relative high heat intensity generation rate. The three-position trigger switch, which provides independent control of the blower and heater element to provide specialized operational modes for use in hair setting, has a "normal" mode position wherein the other two switches control the blower and heater element as described above, a "cool shot" mode position wherein the heater element generates heat intensity at a reduced rate and the blower speed is slowed, and a "hot shot" mode position wherein the heater element generates heat intensity at least at the normal mode rate and the blower speed is decreased with the result that the air flow is heated to higher temperature. The hair dryer also has an electrical circuit which employs the combination of a diac, triac and capacitor in conjunction with the switches to limit the current supplied thereto and thereby to increase the safety of the dryer.

U.S. Pat. No. 5,195,164 to Lambert discloses a hair dryer having a blower trigger and a heat intensity trigger disposed on the front of a handle grip which are pressed for respectively actuating rebound/spring-loaded, graduated intensity switches mounted within the handle grip being respectively capable of controlling the speed of the blower and the intensity of the heater element. The hair dryer also includes a pair of spring-biased locking buttons on the side of the handle grip for interacting with teeth on the sides of the triggers for selectively locking each of the triggers in a selected position between "off" and the maximum position of the incremental switch actuated by the respective trigger.

Like many conventional hair dryers, the ones of the above-cited patents thus employ one or more switches which permit rates of air flow and heat intensity generation to be set at different levels. One disadvantage is that only a few, such as two to four, discrete speed and heat levels are provided. Either a variable heater element or a plurality of separate heater elements are provided to obtain different heat levels. Another disadvantage is that, in order to provide heat intensity and air flow speed control, separate multiple position switches are used requiring effort and skill to correctly manipulate such switches to regulate the temperature and air speeds as desired.

It appears that none of the prior art hair dryers has achieved the degree and ease of control over heat intensity and air flow speed that is desired by many users. Consequently, a need still exists for a hair dryer having heat intensity and air flow speed control which will overcome the drawbacks of the prior art and meet the expectations of users.

SUMMARY OF THE INVENTION

The present invention provides an improved hair dryer designed to satisfy the aforementioned need. The improved hair dryer has a control circuit operable to continuously variably regulate operation of an electric heater element within a continuous range of heat intensities and an electric blower within a continuous range of air flow speeds to produce any desired heated air flow output having a heat intensity and air flow speed within such continuous ranges. The control circuit is relatively simple in design, inexpensive in construction, and reliable in operation. The improved hair dryer also has a pair of actuators which actuate operation of the control circuit to continuously variably regulate the heater element and blower to produce any desired heated air flow output by powering or driving the regulatory function of the control circuit in respective opposite directions.

Furthermore, the control circuit and actuators together actuate and regulate heater element and blower operation to produce the desired heated air flow output by simultaneously and continuously variably regulating (increasing or decreasing) the operation of the heater element to produce the desired level of intensity of heat output and the operation of the blower to produce the desired speed of the air flow output. Such simultaneous and continuously variable regulation of the intensity of the heat output and the speed of the air flow output is performed by manually manipulating the actuators. The actuators are preferably a pair of push button dome-type momentary switches labelled "Up" and "Down". The longer the period of time that the "Up" momentary switch is pressed, the more the heat intensity and air flow speed of the heated air flow output are increased. The longer the period of time that the "Down" momentary switch is pressed, the more the heat intensity and air flow speed of the heated air flow output are decreased.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
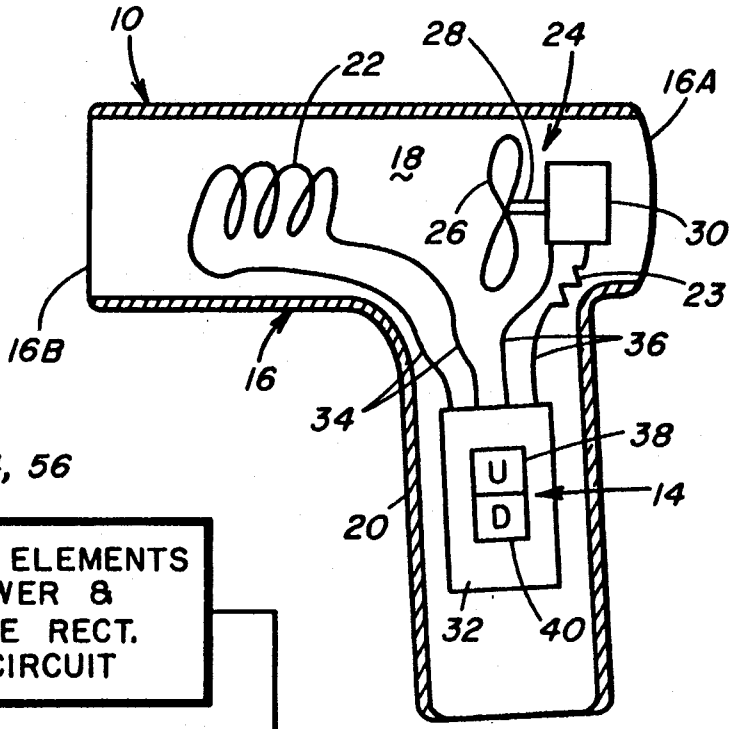
FIG. 1 is a simplified schematic representation of a hair dryer having an electric heater element for producing a heat intensity output and an electric blower for producing an air flow output which is directed over the heater element to produce a heated air flow output from the hair dryer.

Referring to the drawings, and particularly to FIG. 1, there is schematically illustrated a hair dryer, generally designated 10, having a control circuit 12 and means 14 for actuating the control circuit 12 in accordance with the principles of the present invention. By way of example only, the hair dryer 10 basically includes a housing 16 open at opposite rear inlet and front outlet ends 16A, 16B thereof and defining an air flow chamber 18 extending between the opposite rear inlet and front outlet ends 16A, 16B, and a hand grip 20 attached to and extending downwardly from the housing 16 adjacent to the rear inlet end 16A thereof.

The hair dryer 10 also includes an electric heater elements 22, 23 and an electric blower 24 mounted in axially spaced tandem relation to one another in the air flow chamber 18 of the housing 16. The blower 24, which includes an impeller or fan 26 mounted on a rotary output shaft 28 of an electric motor 30, is positioned in the air flow chamber 18 nearer to the rear inlet end 16A of the housing 16, whereas the heater element 22 is positioned in the air flow chamber 18 nearer to the front outlet end 16B of the housing 16. The heater element 22 can be operated to produce any intensity of heat output falling within a continuous range of heat intensities, such as from 0 to 1800 watts. The blower 24 can be operated to produce any speed of air flow output falling within a continuous range of air flow speeds, such as from zero to 750 ft./sec. In view that the air flow output is directed by the blower 24 past and over the heater element 22 before reaching and emerging from the front outlet end 16B of the housing 16, the temperature of a heated air flow output leaving the housing 16 is thereby substantially regulated and determined by the intensity of the heat output produced by the heater element 22.

The control circuit 12 of the hair dryer 10 and actuating means 14 for the control circuit 12 are preferably implemented on a printed circuit board 32 mounted within the hand grip 20 of the hair dryer 10. Pairs of conductor leads 34, 36 electrically connect the heater element 22 and blower 24 to the control circuit 12 and actuating means 14. The operation of the control circuit 12 is actuatable by use of the actuating means 14 to continuously variably regulate the operation of the heater element 22 within the continuous range of heat intensities thereof and the operation of the blower 24 within the continuous range of air flow speeds thereof to produce any desired heated air flow output, emerging from the front outlet end 16B of the housing 16, which has the desired heat intensity (temperature) and desired air flow speed within the respective above-mentioned continuous ranges of heat intensities and air flow speeds.

The actuating means 14 of the hair dryer 10 includes a pair of actuators 38, 40, preferably, in the form of push-button dome-type momentary switches. The momentary switches 38, 40 are manipulated by the user, such as by pressing on them and holding them depressed for the period of time desired, to actuate operation of the control circuit 12. Upon actuation of the control circuit 12 by one or the other of the momentary switches 38, 40, the regulatory function or operation of the control circuit 12 is continuously powered or driven in one or the other of a pair of respective opposite directions so as to simultaneously and continuously variably regulate the heater element 22 and blower 24. In such manner, any desired heat intensity of the heater element 22 and any desired air flow speed of the blower 22 are selected simultaneously and thereby any desired heated air flow output is produced having the desired heat intensity (temperature) and air flow speed within the respective above-mentioned continuous ranges of heat intensities and air flow speeds.

Figure 2:
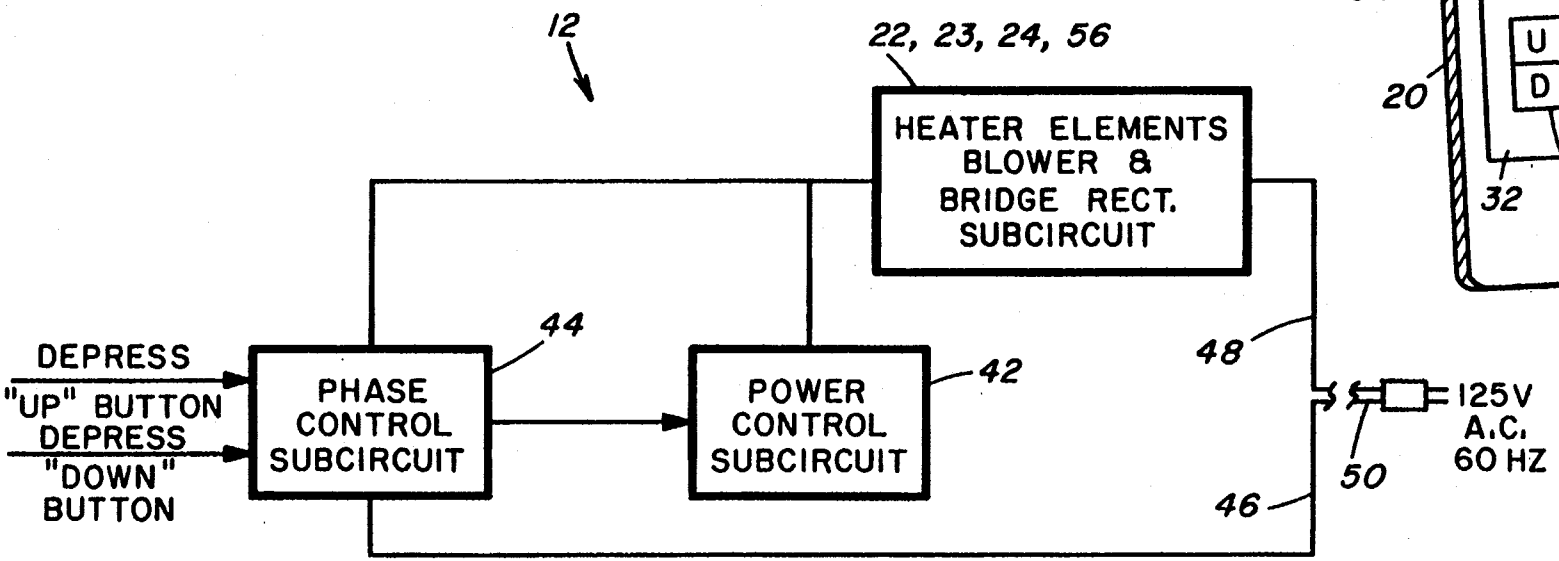
FIG. 2 is a general block diagram of a control circuit and a pair of momentary switches connected to the heater element and blower of the hair dryer in accordance with the present invention.
Figure 3:
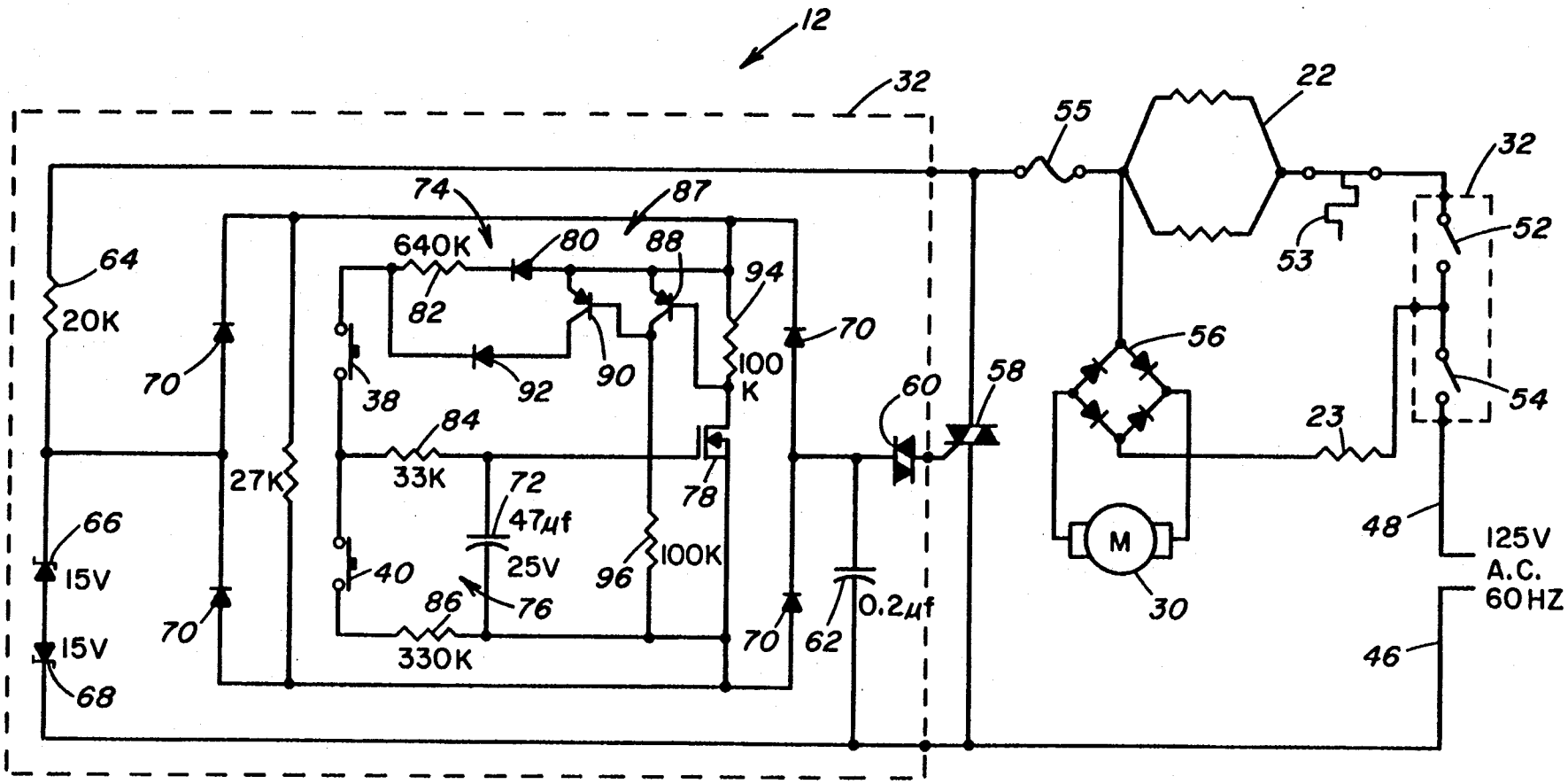
FIG. 3 is a detailed schematic diagram of the control circuit and pair of momentary switches connected to the heater element and blower of the hair dryer in accordance with the present invention.

More particularly, referring to FIGS. 2 and 3, the control circuit 12 includes a power control subcircuit 42 electrically coupled to the heater element 22 and blower motor 30 and being operable for regulating operation of the heater element 22 and blower 24, and a phase control subcircuit 44 coupled to the power control subcircuit 42 and being operable for regulating operation of the power control subcircuit 42 to thereby, in turn, regulate operation of the heater element 22 and blower 24. A pair of line conductor leads 46, 48 of an electrical power cord 50 are connected to the power control subcircuit 42 and the phase control circuit 44 to apply thereto a suitable source of power, such as a 125 volt 60 hertz a.c. electrical signal. Also, a pair of cool shot switch 52 and on-off switch 54 (for the heater elements 22, 23 and the blower motor 30, respectively), a thermostat 53, a thermal fuse 55 and a first diode bridge rectifier subcircuit 56 are interconnected to each other and to the pair of conductor leads 46, 48 of the power cord 50, as shown in FIG. 3.

Referring to FIG. 3, the power control subcircuit 42 includes a triac 58 connected at one side to the one line conductor lead 46 and at the opposite side to the heater elements 22, 23 and to the blower motor 30 via the first diode bridge rectifier subcircuit 56, a diac 60 connected to the gate of the triac 58, a main capacitor 62 connected between the one line conductor lead 46 and the diac 60. Also, the power control subcircuit 42 includes a fixed resistor 64 and a pair of oppositely facing zener diodes 66, 68 connected in series between the one line conductor lead 46 and the opposite side of the triac 58 to restrict and regulate the voltages of the positive and negative half-cycles of the a.c. sine wave applied to the phase control subcircuit 44.

Referring still to FIG. 3, the phase control subcircuit 44 includes diodes 70 connected to form a second diode bridge rectifier subcircuit providing correct polarity for other elements of the subcircuit 44, a secondary capacitor 72, a charging subcircuit portion 74 connected across the secondary capacitor 72, a discharging subcircuit portion 76 connected across the secondary capacitor 72 and an output control driver 78 in the form of a MOSFET transister Q4 connected respectively at its source and gate across the secondary capacitor 72. The resistance of the output control driver 78 for turning on and conducting current is variable depending on the voltage between its gate and source. The voltage stored by the secondary capacitor 72 determines the voltage between the gate and source of the output control driver 78. As the voltage across the secondary capacitor 72 is increasing when the charging subcircuit portion 74 is charging the secondary capacitor 72, the resistance across the gate and source of the output control driver 78 is decreasing. On the other hand, as the voltage across the secondary capacitor 72 is decreasing when the discharging subcircuit portion 76 is discharging the secondary capacitor 72, the resistance across the gate and source of the output output driver 78 is increasing.

The "up" and "down" momentary switches 38, 40 (which are identified as U and D switches respectively in FIG. 1) are connected to the phase control subcircuit 44 and specifically interposed in the charging and discharging subcircuit portions 74, 76 thereof. When the "up" momentary switch 38 is depressed, the secondary capacitor 72 starts to charge through the operation of the charging subcircuit portion 74 (composed of diode 80 and resistors 82, 84). The voltage across the secondary capacitor 72 increases and, in response thereto, the resistance of the output control driver 78 decreases. When the threshold voltage (or resistance) of the output control driver 78 is reached, the output control driver 78 starts to conduct a current which continues to increase in quantity as the voltage across the secondary capacitor 72 continues to increase in response to the continued retention of depression of the "up" momentary switch 38 by the user and continued charging of the charging subcircuit portion 74. The increasing quantity of current from the output control driver 78 of the phase control subcircuit 44 controls the power control subcircuit 42 to conduct a corresponding increasing quantity of current to the heater element 22 and blower motor 30 and accordingly increase the intensity of the heat output and the speed of the air flow output produced thereby.

On the other hand, when the "down" momentary switch 40 is depressed, the secondary capacitor 72 begins to discharge through the discharging subcircuit portion 76 (composed of resistors 84, 86). The voltage across the secondary capacitor 72 decreases and, in response thereto, the resistance of the output control driver 78 increases and the current conducted by the output control driver 78 accordingly decreases and continues to decrease as the voltage across the secondary capacitor 72 continues to decrease in response to the continued retention of depression of the "down" momentary switch 40 by the user and continued discharging of the discharging subcircuit portion 76. The decreasing current from the output control driver 78 of the phase control subcircuit 44 controls the power control subcircuit 42 to conduct a decreasing quantity of current to the heater element 22 and blower motor 30 and accordingly decrease the intensity of the heat output and the speed of the air flow output produced thereby.

When the depression of the respective one of the momentary switches 38, 40 is removed, the secondary capacitor 72 terminates either charging or discharging in response the termination of operation of the respective charging and discharging subcircuit portions 74, 76 of the phase control subcircuit 44. The secondary capacitor 72 will maintain, for a long period of time, the voltage it had across it when the last one of the momentary switch 38, 40 was released. Thus, the last settings of the heat output intensity and air flow output speed will be maintained until changed by the user again operating the respective momentary switches 38, 40 to change the settings.

When the secondary capacitor 72 is completely discharged, it takes a period of time longer than desirable to charge it up to the near the threshold voltage required to turn on the output control driver 78. The phase control subcircuit 44 also includes an auxiliary charging subcircuit portion 87 (composed of transistors 88 and 90, diode 92 and resistors 94 and 96) to assist in speeding up the initial charging of the secondary capacitor 72. It should be observed that current through the output control driver 78 is the same current through the base of the one transistor 88 of the auxiliary charging subcircuit portion 87. The transistor 88 is turned on by this current and blocks the base current of the other transistor 90, thereby turning off and eliminating any additional charge path for the secondary capacitor 72 so that after initial charging of the secondary capacitor 72 is completed, the secondary capacitor 72 is thereafter only charged by the charging subcircuit portion 74.

As mentioned above, the momentary switches 38, 40, respectively labelled "U" for "up" and "D" for "down" are manipulatable by the user to actuate the respective charging and discharging subcircuit portions 74, 76 of the phase control subcircuit 44 of the control circuit 12 to continuously vary operation of the power control subcircuit 42 of the control circuit 12 and thereby regulate the operation of the heater element 22 and blower 24 in order to select any desired heat intensity output of the heater element 22 and any desired air flow speed output of the blower 24 so as to produce a heated air flow output having a desired heat intensity and air flow speed within the respective continuous ranges thereof. The longer the period of time that the "up" momentary switch 38 is held depressed by the user, the more the heat intensity output and air flow speed output of the heated air flow output are increased. The longer the period of time that the "down" momentary switch 40 is held depressed by the user, the more the heat intensity output and air flow speed output of the heated air flow output are decreased.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A hair dryer, comprising:

(a) first electrical means for producing a heat output of any desired intensity within a continuous range of heat intensities;

(b) second electrical means for producing an air flow output of any desired speed within a continuous range of air flow speeds and for directing the air flow output through the heat output to produce a desired heated air flow output with the continuous ranges of heat intensities and air flow speeds;

(c) an electrical control circuit electrically connected to said first electrical means and said second electrical means and being electrically operable in either one of a pair of opposite directions to simultaneously and continuously variably regulate said first electrical means to produce any selected heat intensity within said continuous range thereof and regulate said second electrical means to produce any selected air flow speed within said continuous range thereof so as to produce said desired heated air flow output; and (d) means operated by a user for actuating said electrical control circuit to continuously drive operation of said electrical control circuit in either one of said pair of opposite directions and thereby simultaneously and continuously variably regulate the heat intensity of said first electrical means and the air flow speed of said second electrical means and thereby select a desired heat intensity falling within said continuous range thereof and select a desired air flow speed falling within said continuous range thereof so as to produce said desired heated air flow output;

(e) said heat output intensity and air flow output speed being increased in proportion to a selected period of time that said actuating means is operated by the user to drive operation of said electrical control circuit in one of said pair of opposite directions;

(f) said heat output intensity and air flow output speed being decreased in proportion to a selected period of time that said actuating means is operated by the user to drive operation of said electrical control circuit in the other of said opposite directions.

2. The hair dryer of claim 1 wherein said actuating means is a momentary switch means which is operated by the user.

3. A hair dryer, comprising:

(a) first electrical means for producing a heat output of any desired intensity within a continuous range of heat intensities;

(b) second electrical means for producing an air flow output of any desired speed within a continuous range of air flow speeds and for directing the air flow output through the heat output to produce a desired heated air flow output with the continuous ranges of heat intensities and air flow speeds;

(c) a control circuit electrically connected to said first electrical means and said second electrical means and being operable to simultaneously and continuously variably regulate said first electrical means to produce any selected heat intensity within said continuous range thereof and regulate said second electrical means to produce any selected air flow speed within said continuous range thereof so as to produce said desired heated air flow output; and (d) means for actuating said control circuit to continuously drive operation thereof in either one of a pair of opposite directions and thereby simultaneously and continuously variably regulate the heat intensity of said first electrical means and the air flow speed of said second electrical means and thereby select a desired heat intensity falling within said continuous range thereof and select a desired air flow speed falling within said continuous range thereof so as to produce said desired heated air flow output;

(e) said actuating means being a pair of momentary switches which are actuated by being depressed by a user, one of said momentary switches when depressed causing said control circuit to increase the intensity of heat output and speed of air flow output simultaneously, said heat output intensity and air flow output speed being increased in proportion to the period of time said one momentary switch is held depressed by the user.

4. The hair dryer of claim 3 wherein the other of said momentary switches when depressed causes said control circuit to decrease the intensity of heat output and speed of air flow output simultaneously.

5. The hair dryer of claim 4 wherein said heat output intensity and air flow output speed are decreased in proportion to the period of time said other momentary switch is held depressed by the user.

6. A hair dryer, comprising:

(a) first electrical means for producing a heat output of any desired intensity within a continuous range of heat intensities;

(b) second electrical means for producing an air flow output of any desired speed within a continuous range of air flow speeds and for directing the air flow output through the heat output to produce a desired heated air flow output with the continuous ranges of heat intensities and air flow speeds;

(c) a control circuit electrically connected to said first electrical means and said second electrical means and being operable to simultaneously and continuously variably regulate said first electrical means to produce any selected heat intensity within said continuous range thereof and regulate said second electrical means to produce any selected air flow speed within said continuous range thereof so as to produce said desired heated air flow output; and (d) means for actuating said control circuit to continuously drive operation thereof in either one of a pair of opposite directions and thereby simultaneously and continuously variably regulate the heat intensity of said first electrical means and the air flow speed of said second electrical means and thereby select a desired heat intensity falling within said continuous range thereof and select a desired air flow speed falling within said continuous range thereof so as to produce said desired heated air flow output;.

(e) said control circuit including (i) a power control subcircuit electrically coupled to said respective first and second electrical means and being operable for regulating respective operation thereof; and (ii) a phase control subcircuit coupled to the power control subcircuit and being operable for regulating operation of the power control subcircuit to thereby, in turn, regulate operation of said first and second electrical means.

7. The hair dryer of claim 6 wherein said actuating means is a pair of momentary switches which are actuated by being depressed by a user, said momentary switches being connected to said phase control subcircuit for actuating operation of said phase control subcircuit.

8. The hair dryer of claim 7 wherein said phase control subcircuit includes:

a charging subcircuit portion operable in response to depression of one of said momentary switches to increase the conductive angle of a triggered pulse across said power control subcircuit such that said power control subcircuit, in turn, causes an increase in the intensity of heat output of said first electrical means and in the speed of air flow output of said second electrical means; and a discharging subcircuit portion operable in response to depression of the other of said momentary switches to decrease the conductive angle of the triggered pulse across said power control subcircuit such that said power control subcircuit, in turn, causes a decrease in the intensity of heat output of said first electrical means and in the speed of air flow output of said second electrical means.

9. The hair dryer of claim 8 wherein said phase control subcircuit further includes a capacitor connected to said charging and discharging subcircuit portions of said power control subcircuit, said capacitor being operable to charge and hold an increase in the voltage magnitude applied thereacross in response to depression of said one of said momentary switches such that said increase in the voltage magnitude across said capacitor, in turn, causes said increase in the conductive angle of the triggered pulse across said power control subcircuit, said capacitor also being operable to discharge and hold a decrease in the voltage magnitude applied thereacross in response to depression of said other of said momentary switches such that said decrease in voltage magnitude across said capacitor, in turn, causes said decrease in the conductive angle of the triggered pulse across said power control subcircuit.

10. The hair dryer of claim 7 wherein said phase control subcircuit portion includes:

an output control driver connected to said power control subcircuit;

a capacitor connected to said output control driver;

a charging subcircuit portion connected across said capacitor and being operable to increase the voltage across said capacitor in response to depressing of one of said momentary switches; and a discharging subcircuit portion connected across said capacitor and being operable to decrease the voltage across said capacitor;

whereby operation of said output control driver so as to vary the magnitude of the conductive angle of the triggered pulse to and actuating said power control subcircuit is caused by either operating said charging subcircuit portion to increase the magnitude of voltage across said capacitor and thereby increase the quantity of current conducted by said output control driver or by operating said discharging subcircuit portion to decrease the magnitude of voltage across said capacitor and thereby decrease the quantity of current conducted by said output control driver.

11. A hair dryer, comprising:

(a) an electric heater element adapted to produce any intensity of heat output within a continuous range of heat intensities;

(b) an electric blower adapted to produce any speed of air flow output within a continuous range of air flow speeds, said air flow output being directed past said heater element such that the temperature of the air flow output is regulated and determined by the intensity of the heat output produced by said heater element so as to produce a heated air flow output;

(c) a control circuit electrically connected to said heating element and said blower and being operable to simultaneously and continuously variably regulate said heater element to operate at any selected heat intensity within said continuous range thereof and regulate said blower to operate at any selected air flow speed within said continuous range thereof so as to produce said heated air flow output; and (d) means for actuating said control circuit to continuously drive operation thereof in either one of a pair of opposite directions and thereby simultaneously and continuously variably regulate the heat intensity of said heater element and the air flow speed of said blower and thereby select any desired heat intensity of said heater element falling within said continuous range thereof and select any desired air flow speed of said blower falling within said continuous range thereof so as to produce said heated air flow output having a desired heat intensity and air flow speed falling within said respective continuous ranges thereof;

(e) said actuating means being a pair of momentary switches which are actuated by being depressed by a user, one of said momentary switches when depressed causing said control circuit to increase the intensity of heat output and speed of air flow output simultaneously, said heat output intensity and air flow output speed being increased in proportion to the period of time said one momentary switch is held depressed by the user.

12. The hair dryer of claim 11 wherein the other of said momentary switches when depressed causes said control circuit to decrease the intensity of heat output and speed of air flow output simultaneously.

13. The hair dryer of claim 12 wherein said heat output intensity and air flow output speed are decreased in proportion to the period of time said other momentary switch is held depressed by the user.

14. The hair dryer of claim 13 wherein said phase control subcircuit includes:

a charging subcircuit portion operable in response to depression of one of said momentary switches to increase the conductive angle of a triggered pulse across said power control subcircuit such that said power control subcircuit, in turn, causes an increase in the intensity of heat output of said heater element and in the speed of air flow output of said blower; and a discharging subcircuit portion operable in response to depression of the other of said momentary switches to decrease the conductive angle of the triggered pulse across said power control subcircuit such that said power control subcircuit, in turn, causes a decease in the intensity of heat output of said heater element and in the speed of air flow output of said blower.

15. The hair dryer of claim 14 wherein said phase control subcircuit further includes a capacitor connected to said charging and discharging subcircuit portions of said power control subcircuit, said capacitor being operable to charge and hold an increase in the voltage magnitude applied thereacross in response to depression of said one of said momentary switches such that said increase in the voltage magnitude across said capacitor, in turn, causes said increase in the conductive angle of the triggered pulse across said power control subcircuit, said capacitor also being operable to discharge and hold a decrease in the voltage magnitude applied thereacross in response to depression of said other of said momentary switches such that said decrease in voltage magnitude across said capacitor, in turn, causes said decrease in the conductive angle of the triggered pulse across said power control subcircuit.

16. The hair dryer of claim 14 wherein said phase control subcircuit portion includes:

an output control driver connected to said power control subcircuit;

a capacitor connected to said output control driver;

a charging subcircuit portion connected across said capacitor and being operable to increase the voltage across said capacitor in response to depressing of one of said momentary switches; and a discharging subcircuit portion connected across said capacitor and being operable to increase the voltage across said capacitor;

whereby operation of said output control driver so as to vary the magnitude of the conductive angle of the triggered pulse to and actuating said power control subcircuit is caused by either operating said charging subcircuit portion to increase the magnitude of voltage across said capacitor and thereby increase the quantity of current conducted by said output control driver or by operating said discharging subcircuit portion to decrease the magnitude of voltage across said capacitor and thereby decrease the quantity of current conducted by said output control driver.

* * * * *